US005407594A

United States Patent [19]

Fry et al.

[11] Patent Number: 5,407,594

[45] Date of Patent: Apr. 18, 1995

[54] DETERGENT TABLETS HAVING SPECIFIC PARTICLE SIZE DISTRIBUTION

[75] Inventors: Alan J. Fry; Michael J. Garvey; William J. Iley; Geoffrey Newbold, all of Merseyside; Douglas Wraige, Chester, all of United Kingdom

[73] Assignee: Lever Brothers Company, Division of Conopco, Inc., New York, N.Y.

[21] Appl. No.: 906,907

[22] Filed: Jun. 30, 1992

[30] Foreign Application Priority Data

Jul. 1, 1991 [GB] United Kingdom ..... 9114184

[51] Int. Cl.[6] ..... C11D 17/00; C11D 3/08

[52] U.S. Cl. ..... 252/90; 252/174; 252/135; 252/174.17; 252/174.21; 252/176; 252/174.25; 252/DIG. 16

[58] Field of Search ..... 252/90, 174, 135, 174.17, 252/174.21, 176, 174.25, DIG. 16

[56] References Cited

U.S. PATENT DOCUMENTS

| | | | |
|---|---|---|---|
| 3,081,267 | 4/1963 | Laskey | 252/135 |
| 3,213,029 | 10/1965 | Muchuw et al. | 252/99 |
| 3,231,505 | 1/1966 | Farrar et al. . | |
| 3,953,350 | 4/1976 | Fujino et al. | 252/94 |
| 4,587,031 | 5/1986 | Kruse et al. | 252/135 |
| 4,642,197 | 2/1987 | Kruse et al. | 252/98 |
| 4,673,527 | 6/1987 | Goudy, Jr. et al. | 252/181 |
| 4,800,055 | 1/1989 | Klee et al. | 264/118 |
| 4,897,212 | 1/1990 | Kruse et al. | 252/99 |
| 4,966,606 | 10/1990 | Garner-Gray et al. | 252/174.14 |
| 5,133,892 | 7/1992 | Chyn et al. | 252/90 |

FOREIGN PATENT DOCUMENTS

| | | |
|---|---|---|
| 0170791 | 2/1986 | European Pat. Off. . |
| 0466484 | 1/1992 | European Pat. Off. . |
| 2372890 | 6/1978 | France . |
| 3326459 | 7/1983 | Germany . |
| 60-015500 | 1/1985 | Japan . |
| 60-135497 | 7/1985 | Japan . |
| 60-135498 | 7/1985 | Japan . |
| 2182972 | 7/1990 | Japan . |
| 983243 | 2/1965 | United Kingdom . |
| 989683 | 4/1965 | United Kingdom . |

OTHER PUBLICATIONS

Communication Dated Feb. 16, 1993.
EP Search Report.
U.K. Search Report 9114184.6.

*Primary Examiner*—Paul Lieberman
*Assistant Examiner*—Michael Tierney
*Attorney, Agent, or Firm*—James J. Farrell

[57] ABSTRACT

A tablet of compacted particulate detergent composition in which the tablet, or a discrete region thereof, consists essentially of a matrix of particles substantially free of particles <200 μm. Particles of detergent-active compound and detergent builder and optionally particles of detergent base powder are individually coated with binder/disintegrant capable, when the tablet is immersed in water, of disrupting the structure of the tablet.

13 Claims, No Drawings

DETERGENT TABLETS HAVING SPECIFIC PARTICLE SIZE DISTRIBUTION

TECHNICAL FIELD

The present invention relates to detergent compositions in the form of tablets of compacted detergent powder.

BACKGROUND AND PRIOR ART

Detergent compositions in tablet form are known in the art, as discussed below, and some products are now on the market. Tablets have several advantages over powdered products: they do not require measuring and are thus easier to handle and dispense into the washload, and they are more compact, hence facilitating more economical storage.

Detergent tablets are described, for example, in GB 911 204 (Unilever), U.S. Pat. No. 3,953,350 (Kao), JP 60 015 500A (Lion), JP 60 135 497A (Lion) and JP 60 135 498A (Lion); and are sold commercially in Spain.

Detergent tablets are generally made by compressing or compacting a detergent powder. It has proved difficult, however, to strike a balance between tablet strength and ability to disperse and dissolve in the wash liquor. Tablets formed using only a light compaction pressure tend to crumble and disintegrate on handling and packing; while more strongly compacted tablets may be sufficiently cohesive but will then fail to disintegrate or disperse to an adequate extent in the wash.

This problem has proved especially acute with tablets formed by compressing conventionally produced spray-dried powders containing detergent-active compounds and built with insoluble sodium aluminosilicate (zeolite). As the tablet is wetted, highly viscous gel phases are apparently formed which retard or prevent penetration of water into the interior of the tablet.

It would appear that the problem of disintegration in the wash liquor arises to a much lesser extent when sodium tripolyphosphate is present in the formulation, because the ready solubility and high heat of hydration of the phosphate cause it to behave as a tablet disintegrant. Preparation of satisfactory tablets from modern formulations where sodium tripolyphosphate has been replaced by an insoluble material, crystalline sodium aluminosilicate (zeolite), is proving considerably more difficult.

GB 983 243 and GB 989 683 (Colgate-Palmolive) disclose detergent tablets having improved dissolution properties, prepared by compacting spray-dried detergent powders that have been sprayed with water or with aqueous sodium silicate solution in order to reduce the proportion of fine particles (smaller than 100 mesh (US), equivalent to 149 μm) present. Compaction of powders having particle size ranges of 8–100 mesh and 6–60 mesh (US), equivalent respectively to 149–2380 μm and 250–3360 μm, is disclosed. The whole tablet is coated with a film-forming polymer to aid resistance to abrasion and accidental damage. The powders contain high levels of sodium tripolyphosphate.

EP 466 484A (Unilever PLC) published 15 Jan. 1992 discloses detergent tablets of compacted particles having a narrow size cut, and uniformity and regularity of particle shape; benefits are improved disintegration in the wash and attractive appearance.

It has now been found that greatly improved disintegration and dispersion properties may also be obtained from a tablet consisting essentially of a matrix of compacted granules having a wider particle size range than that disclosed in EP 466 484A (Unilever) published 15 Jan. 1992 provided that at least the particles of detergent-active compound and detergent builder are coated with binder/disintegrant before tablet compaction. The benefits are especially apparent in tablets prepared from zeolite-built detergent powders, and from high-bulk-density detergent powders.

DEFINITION OF THE INVENTION

The present invention accordingly provides a tablet of compacted particulate detergent composition comprising a detergent-active compound, a detergency builder, and optionally other detergent ingredients, characterised in that the tablet or a discrete region thereof, consists essentially of a matrix of particles substantially free of particles <200μm, the particles of detergent-active compound and detergent builder and optionally the particles of indgredients of the detergent base powder being individually coated with a binder/-disintegrant capable, when the tablet is immersed in water, of disrupting the structure of the tablet; with the proviso that substantially all of the particles of the matrix do not have a particle size within a range having upper and lower limits differing from each other by not more than 700 μm.

DETAILED DESCRIPTION OF THE INVENTION

The detergent tablet of the invention, or a discrete region of the tablet, is in the form of a matrix derived by compaction from a particulate composition consisting essentially of particles at least some of which are coated with binder/disintegrant, the particle size range being relatively wide, but small particles ("fines") <200 μm being substantially absent.

Particle size and distribution

The matrix which is an essential feature of the detergent tablet of the invention, is derived by compaction of a particulate detergent composition substantially free of small particles, and preferably of controlled particle size and distribution.

Preferably, the composition consists substantially wholly of particles within the size range of 200 to 2000 μm, more preferably from 250 to 1400 μm, and is desirably substantially free of both larger and smaller particles. By "substantially" is meant that not more than 5 wt % of particles should be larger than the upper limit, and not more than 5 wt % should be smaller than the lower limit.

This distribution is different from that of a conventional spray-dried detergent powder. Although the average particle size of such a powder is typically about 300–500 μm, the particle size distribution will include a "fines" (particles ≦200 μm) content of 10–30 wt %.

Such a powder may nevertheless be a suitable starting material for a tablet according to the present invention, if the fines are eliminated first by sieving.

While the starting particulate composition may in principle have any bulk density, the present invention is especially relevant to tablets made by compacting powders of relatively high-bulk-density, because of their greater tendency to exhibit disintegration and dispersion problems. Such tablets have the advantage that, as compared with a tablet derived from a low-bulk-density powder, a given dose of detergent composition can be presented as a smaller tablet.

Thus the starting particulate composition may suitably have a bulk density of at least 400 g/liter, preferably at least 500 g/liter, and advantageously at least 700 g/liter.

Granular detergent compositions of high bulk density prepared by granulation and densification in a high-speed mixer/granulator, as described and claimed in EP 340 013A (Unilever), EP 352 135A (Unilever), and EP 425 277A (Unilever), or by the continuous granulation/densification processes described and claimed in EP 367 339A (Unilever) and EP 390 251A (Unilever), are inherently suitable for use in the present invention.

Most preferred are granular detergent compositions prepared by granulation and densification in the high-speed mixer/granulator (Fukae mixer), as described in the above-mentioned EP 340 013 A (Unilever) and EP 425 277 A (Unilever). With some compositions, this process can produce granular compositions satisfying the criteria of particle size distribution given above, without sieving or other further treatment.

The tablet of the invention may be either homogeneous or heterogeneous. In the present specification, the term "homogeneous" is used to mean a tablet produced by compaction of a single particulate composition, but does not imply that all the particles of that composition will necessarily be of identical composition. The term "heterogeneous" is used to mean a tablet consisting of a plurality of discrete regions, for example, layers, inserts or coatings, each derived by compaction from a particulate composition.

In a heterogeneous tablet, any one or more of the discrete regions may consist essentially of a matrix as defined above. Where two or more such matrices are present in different regions, they may have the same or different particle size ranges: for example, a first region (for example, outer layer) may consist essentially of particles with a relatively wide particle size range (for example, 250 to 1400 μm) while another (inner core) may consist essentially of particles with a relatively narrow particle range (for example, 500 to 710 μm).

It is within the scope of the invention, for a minor proportion of visually contrasting particles not within the size range of the matrix to be present: the most obvious example of this being the inclusion of a small proportion of much larger particles. In this embodiment of the invention, the visually contrasting particles must be larger in at least one dimension than the matrix particles. The effect of contrast may be enhanced if the non-matrix particles are of a contrasting shape, for example, noodles. Visual contrast may if desire be further emphasised by the use of a contrasting colour.

As previously indicated, it is not necessary for all the particles constituting the matrix to be of identical composition. The particulate starting composition may be a mixture of different components, for example, a spray-dried detergent base powder, surfactant particles, additional builder salts, bleach ingredients and enzyme granules, provided that all satisfy the criteria on particle size.

Binder/Disintegrant

According to the second essential feature of the invention, at least the particles of detergent-active compound and detergent builder are coated with a binder, which is also capable of acting as a disintegrant by disrupting the structure of the tablet when the tablet is immersed in water, before admixing with the other optional detergent ingredients and compaction into a tablet.

Optionally, the particles of ingredients of the detergent base powder maybe coated with binder/disintegrant. However, particles of ingredients which are typically post-dosed, for example bleach, enzymes, are preferably not coated with binder/disintegrant.

Use of a binder helps to hold the tablet together, thus enabling it to be made using a lower compaction pressure and making it inherently more likely to disintegrate well in the wash liquor. If the binder is also a material that causes disruption when contacted with water, even better disintegration properties may be achieved.

Tablet disintegrants are well known in the pharmaceutical art and are known to act by four principle mechanisms: swelling, porosity and capillary action (wicking), and deformation (all physical), and effervescence (chemical). Tablet disintegrants in the pharmaceutical industry are reviewed by W Lowenthal, Journal of Pharmaceutical Sciences Volume 61, No. 11 (November 1972).

However, since it is essential for the binder/disintegrant to coat or envelop the particles of at least the detergent-active compound and the detergent builder and, optionally, the particles of ingredients of the detergent base powder, rather than simply to be mixed with them, only physical disintegrants are suitable. These include organic materials such as starches, for example, corn, maize, rice and potato starches and starch derivatives, such as Primojel (Trade Mark) carboxymethyl starch and Explotab (Trade Mark) sodium starch glycolate; celluloses and cellulose derivatives, for example, Courlose (Trade Mark) and Nymcel (Trade Mark) sodium carboxymethyl cellulose, Ac-di-Sol (Trade Mark) cross-linked modified cellulose, and Hanfloc (Trade Mark) microcrystalline cellulosic fibers; and various synthetic organic polymers, notably polyethylene glycol; crosslinked polvinyl pyrrolidone, for example, Polyplasdone (Trade Mark) XL or Kollidon (Trade Mark) CL. Inorganic swelling disintegrants include bentonite clay.

The binder/disintegrant may suitably be applied to the particles by spraying on in solution or dispersion form. Some disintegrants may additionally give a functional benefit in the wash, for example, supplementary building, antiredeposition or fabric softening.

Preferred binder/disintegrants are polymers. A more preferred binder/disintegrant is crosslinked polyvinyl pyrrolidone, for example, Polyplasdone (Trade Mark) XL or Kollidon (Trade Mark) CL.

An especially preferred binder/disintegrant is polyethylene glycol.

The binder/disintegrant is preferably used in an amount within the range of from 0.1 to 10 wt %, more preferably from 1 to 5 wt %.

It is also within the scope of the invention to use, in addition to the binder/disintegrant required to coat at least the particles of detergent active compound and detergent builder, a binder that has no disintegrant properties, or a disintegrant that has no binder properties. An example of the latter type of material is an effervescent (chemical) disintegrant.

Effervescent disintegrants include weak acids or acid salts, for example, citric acid, maleic acid or tartaric acid, in combination with alkali metal carbonate or bicarbonate; these may suitably be used in an amount of from 1 to 25 wt %, preferably from 5 to 15 wt %. Further examples of acid and carbonate sources and other effervescent systems may be found in Pharmaceutical Dosage Forms: Tablets, Volume 1, 1989, pages 287–291 (Marcel Dekker Inc, ISBN 0-8247-8044-2).

Tablet binders are well known in the art and include natural gums (for example, acacia, tragacanth) and sugars (for example, glucose, sucrose).

Disintegration

The detergent tablet of the invention should be capable of rapid disintegration in the wash liquor. For the purposes of the present invention, disintegration time has been investigated by means of the following test.

The tablet is weighed, placed in a cage of perforated metal gauze (9 cm×4.5 cm×2 cm) having 16 apertures (each about 2.5 mm square) per $cm^2$. The cage is then suspended in a beaker of demineralised water at 20° C. and rotated at 80 rpm. The time taken for the tablet to disintegrate and fall through the gauze (the disintegration time) is recorded; after 10 minutes, if the tablet has not wholly disintegrated, the residue is determined by weighing after drying.

It will be appreciated that this is a very stringent test, since water temperature and agitation are both much lower than in a real wash situation in a machine with a washload present. Disintegration times under real wash conditions are expected to be shorter.

The tablet of the invention should ideally have a disintegration time (as defined above) not exceeding 10 minutes, and preferably not exceeding 5 minutes. However, in view of the extreme stringency of the test methodology, a more realistic criterion correlating better with washing machine results (see below) appears to be that the residue after 10 minutes should preferably not exceed 75 wt %, and more preferably should not exceed 50 wt %.

Also important is the time taken for the tablet to disperse or dissolve, and thereby release its active ingredients into the wash liquor. Dissolution times have been investigated in a National W102 top-loading impeller-driven washing machine, using a 10-minute wash cycle and determining any undispersed residues remaining (by drying and weighing) after 5 minutes. During the 5-minute period, dissolution is monitored by conductivity measurement: the dissolution time is defined as the time taken for the conductivity to reach a plateau. It will be appreciated that conductivity measures only the dissolution of the water-soluble ingredients of the tablet, while any insoluble ingredients (notably zeolite) will simultaneously be dispersed.

Ideally a tablet suitable for use in this type of washing machine should be completely dispersed or dissolved in less than 5 minutes. It will be appreciated, however, that less stringent criteria need be applied when the tablet is intended for use in a washing machine, for example, a typical European drum-type machine, having a wash cycle involving a longer time period, a higher wash temperature or a greater degree of agitation.

Tabletting

As previously indicated, the tablets of the invention are prepared by compaction of a particulate starting material. Any suitable tabletting apparatus may be used.

For any given starting composition, the disintegration time (as defined above) will vary with the compaction pressure used to form the tablet. If the compaction pressure is too low, the tablet will tend to crumble and break up in the dry state, on handling and packaging; an increase in compaction pressure will improve tablet integrity, but eventually at the expense of disintegration time in the wash liquor.

Using an Instron (Trade Mark) Universal Testing Machine at constant speed, or a Research and Industrial screw hand press, to operate a steel punch and die, it has been found that effective tablets may be produced using compaction pressures ranging from 0.1 to 20 MPa, especially from 0.1 to 10 MPa, more especially from 0.1 to 5 MPa.

The optimum compaction pressure will depend to some extent on the starting composition; for example, a formulation containing a high proportion of organic ingredients (for example, surfactants) and a low proportion of inorganic salts may require a compaction pressure lower than that required for a formulation containing a lower proportion of organic ingredients and a higher proportion of inorganic salts; and a dry-mixed formulation will generally require a higher pressure than will a spray-dried powder.

As a measure of the resistance of the tablets to fracture, the diametral fracture stress $\sigma_o$ calculated from the following equation:

$$\sigma_o = \frac{2P}{\pi Dt}$$

where $\sigma_o$ is the diametral feature stress (Pa), P is the applied load to cause fracture (N), D is the tablet diameter (M) and t is the tablet thickness (M).

Tablets of the invention preferably have a diametral fracture stress of at least 5 kPa, and more preferably at least 7 kPa.

Tablet Forms

The detergent tablet of the invention may be, and preferably is, formulated for use as a complete heavy-duty fabric washing composition. The consumer then does not need to use a mix of tablets having different compositions.

Although one tablet may contain sufficient of every component to provide the correct amount required for an average washload, it is convenient if each tablet contains a submultiple quantity of the composition required for average washing conditions, so that the consumer may vary the dosage according to the size and nature of the washload. For example, tablet sizes may be chosen such that two tablets are sufficient for an average washload; one or more further tablets may be added if the washload is particularly large of soiled; and one only tablet may be used if the load is small or only lightly soiled.

Alternatively, larger subdivisible tablets representing a single or multiple dose may be provided with scorings or indentations to indicate unit dose or submultiple unit dose size to the consumer and to provide a weak point to assist the consumer in breaking the tablet if appropriate.

The size of the tablet will suitably range from 10 to 160 g, preferably from 15 to 60 g, depending on the wash conditions under which it is intended to be used, and whether it represents a single dose, a multiple dose or a submultiple dose.

The tablet may be of any suitable shape, but for manufacturing and packaging convenience is preferably of uniform cross-section, for example, circular (preferred) or rectangular.

As previously indicated, the tablet of the invention may be homogeneous, or may consist of more than one discrete region: for example, two or more layers of different composition may be present, or a core region may be wholly surrounded by an outer region of different composition.

Detergent-active Compounds

The total amount of detergent-active material in the tablet of the invention is suitably from 2 to 50wt %, and is preferably from 5 to 40 wt %. Detergent-active material present may be anionic (soap or non-soap), cationic, zwitterionic, amphoteric, nonionic or any combination of these.

Anionic detergent-active compounds may be present in an amount of from 2 to 40wt %, preferably from 4 to 30 wt %.

Synthetic anionic surfactants are well known to those skilled in the art. Examples include alkylbenzene sulphonates, particularly sodium linear alkylbenzene sulphonates having an alkyl chain length of $C_8$–$C_{15}$; primary and secondary alkyl sulphates, particularly sodium $C_{12}$–$C_{15}$ primary alcohol sulphates; olefin sulphonates; alkane sulphonates; dialkyl sulphosuccinates; and fatty acid ester sulphonates.

It may also be desirable to include one of more soaps of fatty acids. These are preferably sodium soaps derived from naturally occurring fatty acids, for example, the fatty acids from coconut oil, beef tallow, sunflower or hardened rapeseed oil.

Anionic surfactants are preferably concentrated in discrete domains as described and claimed in our copending application GB 90 15504.5 (Unilever PLC).

Suitable nonionic detergent compounds which may be used include in particular the reaction products of compounds having a hydrophobic group and a reactive hydrogen atom, for example, aliphatic alcohols, acids, amides or alkyl phenols with alkylene oxides, especially ethylene oxide either alone or with propylene oxide.

Specific nonionic detergent compounds are alkyl $C_{6-22}$) phenol-ethylene oxide condensates, the condensation products of linear or branched aliphatic $C_{8-20}$ primary or secondary alcohols with ethylene oxide, and products made by condensation of ethylene oxide with the reaction products of propylene oxide and ethylenediamine. Other so-called nonionic detergent compounds include long-chain tertiary amine oxides, tertiary phosphine oxides, and dialkyl sulphoxides.

Especially preferred are the primary and secondary alcohol ethoxylates, especially the $C_{12-15}$ primary and secondary alcohols ethoxylated with an average of from 5 to 20 moles of ethylene oxide per mole of alcohol.

The nonionic detergent-active compounds are preferably concentrated in discrete domains. Since the nonionic detergent compounds are generally liquids, these domains are preferably formed from any of the well-known carriers in the detergent business impregnated by nonionic detergent-active compound. Preferred carriers include zeolite; zeolite granulated with other materials, for example, Wessalith CS (Trade Mark), Wessalith CD (Trade Mark), Vegabond GB (Trade Mark), sodium perborate monohydrate; Burkeite (spray-dried sodium carbonate and sodium sulphate as disclosed in EP 221 776 (Unilever)).

Nonionic detergent-active compounds may optionally be mixed with materials which make the granules slow wetting and/or prevent the nonionic leaching out into the main tablet matrix. Such materials may suitably be fatty acids, especially lauric acid.

Detergency Builders

The detergent tablets of the invention contain one or more detergency builders, suitably in an amount of from 5 to 80 wt %, preferably from 20 to 80 wt %.

The invention is of especial relevance to tablets derived from detergent compositions containing alkali metal aluminosilicates as builders, since such tablets appear to have a particular tendency to exhibit disintegration and dispersion problems.

Alkali metal (preferably sodium) aluminosilicates may suitably be incorporated in amounts of from 5 to 60% by weight (anhydrous basis) of the composition, and may be either crystalline or amorphous of mixtures thereof, having the general formula:

$$0.8\text{–}1.5\ Na_2O.\ Al_2O_3.\ 0.8\text{–}6\ SiO_2$$

These materials contain some bound water and are required to have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as amply described in the literature.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof. Also of interest is the novel zeolite P described and claimed in EP 384 070 (Unilever).

Other builders may also be included in the detergent tablet of the invention if necessary or desired: suitable organic or inorganic water-soluble or water-insoluble builders will readily suggest themselves to the skilled detergent formulator. Inorganic builders that may be present include alkali metal (generally sodium) carbonate; while organic builders include polycarboxylate polymers, such as polyacrylates, acrylic/maleic copolymers, and acrylic phosphinates; monomeric polycarboxylates such as citrates, gluconates, oxydisuccinates, glycerol mono-, di- and trisuccinates, carboxymethyloxysuccinates, carboxymethyloxymalonates, dipicolinates, hydroxyethyliminodiacetates; and organic precipitant builders such as alkyl- and alkenylmalonates and succinates, and sulphonated fatty acid salts.

Especially preferred supplementary builders are polycarboxylate polymers, more especially polyacrylates and acrylic/maleic copolymers, suitably used in amounts of from 0.5 to 15 wt %, especially from 1 to 10 wt %; and monomeric polycarboxylates, more especially citric acid and its salts, suitably used in amounts of from 3 to 20 wt %, more preferably from 5 to 15 wt %.

Preferred tabletted compositions of the invention preferably do not contain more than 5 wt % of inorganic phosphate builders, and are desirably substantially free of phosphate builders. However, phosphate-built tabletted compositions are also within the scope of the invention.

Other Ingredients

Preferred tabletted detergent compositions according to the invention suitably contain 10–20 wt % sodium carbonate, in order to achieve a desired pH of greater than 9. However, we have discovered that the addition of sodium carbonate into the initial slurry which is spray-dried to form the base powder can influence the final tablet strength. This effect can be minimised to some extent by post-dosing the sodium carbonate prior to tabletting.

Tabletted detergent compositions according to the invention may also suitably contain a bleach system. This preferably comprises one or more peroxy bleach compounds, for example, inorganic persalts or organic peroxyacids, which may be employed in conjunction with activators to improve bleaching action at low wash temperatures.

Preferred inorganic persalts are sodium perborate monohydrate and tetrahydrate, and sodium percarbonate, advantageously employed together with an activator. Bleach activators, also referred to as bleach precursors, have been widely disclosed in the art. Preferred examples include peracetic acid precursors, for example, tetraacetylethylene diamine (TAED), now in widespread commercial use in conjunction with sodium perborate; and perbenzoic acid precursors. The novel quaternary ammonium and phosphonium bleach activators disclosed in U.S. Pat. No. 4,751,015 and U.S. Pat. No. 4,818,426 (Lever Brothers Company) are also of great interest. The bleach system may also include a bleach stabiliser (heavy metal sequestrant) such as ethylenediamine tetramethylene phosphonate and diethylenetriamine pentamethylene phosphonate. The skilled detergent worker will have no difficulty in applying the normal principles of formulation to choose a suitable bleach system.

The detergent tablets of the invention may also contain one of the detergency enzymes well-known in the art for their ability to degrade and aid in the removal of various soils and stains. Suitable enzymes include the various proteases, cellulases, lipases, amylases, and mixtures thereof, which are designed to remove a variety of soils and stains from fabrics. Examples of suitable proteases are Maxatase (Trade Mark), as supplied by Gist-Brocades N.V., Delft, Holland, and Alcalase (Trade Mark), Esperase (Trade Mark), and Savinase (Trade Mark), as supplied by Novo Industri A/S, Copenhagen, Denmark. Detergency enzymes are commonly employed in the form of granules or marumes, optionally with a protective coating, in amounts of from about 0.1% to about 3.0% by weight of the composition; and these granules or marumes present no problems with respect to compaction to form a tablet.

The detergent tablets of the invention may also contain a fluorescer (optical brightener), for example, Tinopal (Trade Mark) DMS or Tinopal CBS available from Ciba-Geigy AG, Basel, Switzerland. Tinopal DMS is disodium 4,4'bis(2-morpholino-4-anilino-s-triazin-6-ylamino) stilbene disulphonate; and Tinopal CBS is disodium 2,2'-bis(phenyl-styryl) disulphonate.

An antifoam material is advantageously included in the detergent tablet of the invention, especially if the tablet is primarily intended for use in front-loading drum-type automatic washing machines. Suitable antifoam materials are usually in granular form, such as those described in EP 266 863A (Unilever). Such antifoam granules typically comprise a mixture of silicone oil, petroleum jelly, hydrophobic silica and alkyl phosphate as antifoam active material, sorbed onto a porous absorbent water-soluble carbonate-based inorganic carrier material. Antifoam granules may be present in any amount up to 5% by weight of the composition.

It may also be desirable to include in the detergent tablet of the invention an amount of an alkali metal silicate, particularly sodium ortho-, meta- or preferably alkali metal silicates at levels, for example, of 0.1 to 10 wt %, may be advantageous in providing protection against the corrosion of metal parts in washing machines, besides providing some measure of building and giving processing benefits.

Further ingredients which can optionally be employed in the detergent tablet of the invention include antiredeposition agents such as sodium carboxymethylcellulose, straight-chain polyvinyl pyrrolidone and the cellulose ethers such as methyl cellulose and ethyl hydroxethyl cellulose; fabric-softening agents; heavy metal sequestrants such as EDTA; perfumes; pigments, colorants or coloured speckles; and inorganic salts such as sodium and magnesium sulphate. Sodium sulphate may if desired be present as a filler material in amounts up to 40% by weight of the composition; however as little as 10% or less by weight of the composition of sodium sulphate, or even none at all, may be present.

As well as the functional detergent ingredients listed above, there may be present various ingredients specifically to aid tabletting. Binders and disintegrants have already been discussed. Tablet lubricants include calcium, magnesium and zinc soaps (especially stearates), talc, glyceryl behapate, Myvatex (Trade Mark) TL ex Eastman Kodak, sodium benzoate, sodium acetate, polyethylene glycols, and colloidal silicas (for example, Alusil (Trade Mark) ex Crosfield Chemicals Ltd).

As indicated previously, some ingredients may give both functional wash benefits and tabletting benefits.

EXAMPLES

The following non-limiting Examples illustrate the invention. Parts and percentages are by weight unless otherwise stated. Examples identified by numbers are in accordance with the invention, while those identified by letters are comparative.

Examples 1 to 3

A granular detergent composition was prepared to the following formulation:

| | % |
|---|---|
| Linear alkylbenzene sulphonate | 25.0 |
| Nonionic surfactant | 1.5 |
| Soap | 1.0 |
| zeolite (anhydrous) | 35.0 |
| Water with zeolite | 10.0 |
| Sodium silicate | 4.0 |
| Acrylic/maleic copolymer | 1.5 |
| Fluorescer | 0.18 |
| SCMC | 0.6 |
| Sodium carbonate | 14.3 |
| Enzyme (alcalase (Trade Mark)) | 0.6 |
| Antifoam | 0.04 |
| Alusil N | 2.5 |
| Miscellaneous (speckles, perfume, salts, water) | 3.78 |
| | 100.00 |

The composition was prepared as follows: all ingredients except the enzyme, speckles and perfume were slurried and spray-dried to give a base powder; the base powder was granulated and densified in the Fukae (Trade Mark) FS-100 high speed mixer-granulator, as described and claimed in EP 340 013A (Unilever), to give a granular product of bulk density >720 g/liter.

A slurry of the binder/disintegrant, specified below in acetone was then sprayed onto the base powder to give a coating level of 3 wt % before admixing the enzymes, speckles and perfume.

Binder/disintegrants used were:

Example 1-cross-linked polyvinyl pyrrolidone (polyplasdone XL)

Example 2-polyethylene glycol 1500

Example 3-acrylic/maleic copolymer

The resulting product consisted of dense, substantially spherical granules, the particle size distribution being as follows:

| | wt % |
|---|---|
| <180 μm | 2.03 |
| 180–250 μm | 17.07 |
| 250–500 μm | 37.20 |
| 500–710 μm | 15.45 |
| 710–1000 μm | 10.98 |
| 1000–1700 μm | 14.63 |
| >1700 μm | 2.64 |
| | 100.00 |

The particles having a size of <250 μm were removed by sieving as were particles >1400 μm in size. Upper and lower particle limits therefore differed by 1150 μm.

Comparative Example A

A granular detergent base composition was prepared as in Examples 1–3. However, no binder/disintegrant was sprayed onto the base powder coating the particles. Particles <250 μm and >1400 μm in size were removed as in Examples 1–3.

Comparative Example B

A granular detergent base composition was prepared as in Examples 1–3. However, no binder/disintegrant was sprayed onto the base powder coating the particles. Only particles >1400 μm in size were removed, particles <250 μm in size remaining within the powder.

Comparative Example C

A granular detergent base composition was prepared as in Examples 1–3. A slurry of polyethylene glycol 1500 in acetone was sprayed onto the base powder to give a coating level of 3 wt %, before admixing the enzymes, speckles and perfume. Only particles >1400 μm in size were removed, particles <250 μm in size remaining within the powder.

Tablet Preparation

Detergent tablets were prepared by compaction of the detergent powder formulations of Examples 1 to 3 and Comparative Examples A to C at compaction pressures sufficient to produce a diametral fracture stress of at least 5 kPa which was determined as described earlier. The actual diametral fracture stresses obtained are shown in the Table. The tablets were produced using an Instron Universal Testing Machine to operate a steel punch and 40 mm die. The tablets obtained were of circular cross-section having a diameter of 4.0 cm and a thickness of approximately 1 cm.

Comparative Example D

A detergent powder formulation of comparative Example B was prepared and compacted into tablets as described above. The tablets were then coated up to a level of 3 wt % with polyethylene glycol 1500.

Determination of Tablet Properties

Dissolution times, measured according to the test previously described were as shown in the table overleaf.

Examples 1 to 3; Comparative Examples A to D

| Example | Diametral Fracture Stress (kPa) | Compaction Pressure (MPa) | Dissolution Time $T_{50}$ (min) | Dissolution Time $T_{90}$ (min) | Undissolved Residue Remaining After 5 min (wt %) |
|---|---|---|---|---|---|
| 1 | 28.0 | 0.15 | 1.0 | 3.0 | 0 |
| 2 | 28.6 | 0.1 | 1.0 | 2.4 | 0 |
| 3 | 20.9 | 0.15 | 2.5 | 4.5 | 0 |
| A(i) | 32.0 | 0.25 | 4.0 | >5.0 | — |
| A(ii) | 35.0 | 0.3 | — | >5.0 | 1.5 |
| B | 27.4 | 0.3 | — | >5.0 | 9.7 |
| C | 27.0 | 0.3 | — | >5.0 | 1.0 |
| D | 38.0 | 0.3 | — | >5.0 | 10.0 |

We claim:

1. A tablet of compacted particulate detergent composition comprising:

2 to 50% by weight of a detergent active compound selected from the group consisting of anionic, nonionic, zwitterionic and amphoteric detergents and mixtures thereof; and 20 to 80% by weight of a detergent builder characterized in that the tablet consists essentially of a matrix of particles at least 90% of which lie within a size range of 200 to 2000 μm with not more than 5 wt. % of the particles larger than 2000 μm and not more than 5 wt. % smaller than 200 μm, the particles of detergent active compound and detergent builder being individually coated with a polymeric material serving as a binder in the tablet and serving as a disintegrant which, when the tablet is immersed in water, is capable of disrupting the structure of the tablet.

2. A detergent tablet as claimed in claim 1, wherein the upper and lower limits on the particle size of the particles constituting the matrix lie within the range of from 250 to 1400 μm.

3. A detergent tablet as claimed in claim 1, wherein the binder/disintegrant is present in an amount of from 0.1 to 10 wt % based on the tablet.

4. A detergent tablet as claimed in claim 3, wherein the binder/disintegrant is present in an amount of from 1 to 5 wt %.

5. A detergent tablet is claimed in claim 3, wherein the binder/disintegrant is capable of effecting disruption of the tablet structure in water.

6. A detergent tablet as claimed in claim 3, wherein the binder/disintegrant comprises crosslinked polyethylene glycol.

7. A detergent tablet as claimed in claim 1, wherein the matrix is derived by compaction from a particulate composition having a bulk density of at least 500 g/liter.

8. A detergent tablet as claimed in claim 1, wherein the matrix is derived by compaction from a particulate composition having a bulk density of at least 700 g/liter.

9. A detergent tablet as claimed in claim 1, which comprises from 5 to 60 wt % (anhydrous basis) of alkali metal aluminosilicate.

10. A detergent tablet as claimed in claim 1 which comprises from 10 to 20 wt % of post-dosed sodium carbonate.

11. A detergent tablet as claimed in claim 1, which has a dissolution time of ≦5 minutes.

12. A detergent tablet as claimed in claim 1 having a diametral fracture stress of at least 5.0 kPa.

13. A detergent tablet as claimed in claim 12, having a diametral fracture stress of at least 7.0 kPa.

* * * * *